US010471505B2

(12) United States Patent
Cousin et al.

(10) Patent No.: US 10,471,505 B2
(45) Date of Patent: Nov. 12, 2019

(54) SLIDING CLOSURE FOR A CONTAINER CONTAINING MOLTEN METAL

(71) Applicant: Refractory Intellectual Property GmbH & Co. KG, Vienna (AT)

(72) Inventors: Jean-Daniel Cousin, Lucerne (CH); Rebecca Gisler, Hochdorf (CH)

(73) Assignee: Refractory Intellectual Property GmbH & Co. KG, Vienna (AT)

( * ) Notice: Subject to any disclaimer, the term of this patent is extended or adjusted under 35 U.S.C. 154(b) by 186 days.

(21) Appl. No.: 15/545,109

(22) PCT Filed: Nov. 27, 2015

(86) PCT No.: PCT/EP2015/077972
§ 371 (c)(1),
(2) Date: Jul. 20, 2017

(87) PCT Pub. No.: WO2016/116197
PCT Pub. Date: Jul. 28, 2016

(65) Prior Publication Data

US 2018/0009028 A1 Jan. 11, 2018

(30) Foreign Application Priority Data

Jan. 23, 2015 (CH) ..... 0091/15

(51) Int. Cl.
*E06B 7/00* (2006.01)
*B22D 41/40* (2006.01)
*B22D 41/24* (2006.01)

(52) U.S. Cl.
CPC ..... *B22D 41/40* (2013.01); *B22D 41/24* (2013.01)

(58) Field of Classification Search
CPC ..... B22D 41/40; B22D 41/24; B22D 11/10; B22D 11/11; B22D 41/38; Y10T 29/49826
(Continued)

(56) References Cited

U.S. PATENT DOCUMENTS 4,508,241 A * 4/1985 Bauer ..... B22D 41/34 222/561
4,603,842 A * 8/1986 King ..... F27D 3/1509 222/590
(Continued)

FOREIGN PATENT DOCUMENTS

CH 639301 A5 11/1983
CH 673097 A5 2/1990
(Continued)

OTHER PUBLICATIONS

Abstract of CH 673097 A5.
Abstract of CH 639301 A5.
Abstract of WO 03/103878 A1.

*Primary Examiner* — Chi Q Nguyen
(74) *Attorney, Agent, or Firm* — Brian Roffe

(57) ABSTRACT

Slide closure for a container containing molten metal includes a housing part that can be fastened to the container and a slider unit that can be displaced longitudinally relative to it, into which a fireproof plate can respectively be inserted. The slider unit is held by holding units fastened to the housing part perpendicular to the slider unit such that it can be displaced longitudinally. The holding units are individually fastened releaseably to the housing part such that in the braced state of the slide closure, they can be released from the housing part in almost every position of the slider unit. In addition, the housing part has walls running close to the plate in the longitudinal direction and projections that
(Continued)

protrude to the side, in which walls bearings of the individual holding units can be accommodated.

20 Claims, 2 Drawing Sheets

(58) Field of Classification Search
USPC ..... 49/70; 266/271; 269/134, 234, 138; 222/591, 600, 597
See application file for complete search history.

(56) References Cited

U.S. PATENT DOCUMENTS 4,848,604 A * 7/1989 Fricker ..... B22D 41/24 222/600
4,867,428 A * 9/1989 Fricker ..... B22D 41/34 269/134
5,110,018 A * 5/1992 Lothmann ..... B22D 41/40 222/600
5,421,563 A 6/1995 Holtermann et al.
6,422,435 B1 * 7/2002 Toaldo ..... B22D 41/40 222/600
6,873,771 B2 * 3/2005 Kwon ..... G02B 6/3616 269/287
7,648,053 B2 * 1/2010 Rose ..... B22D 41/24 222/594
8,371,484 B2 * 2/2013 Keller ..... B22D 41/38 222/600
8,795,583 B2 8/2014 Heller et al.
8,887,969 B2 11/2014 Steiner et al.
8,991,663 B2 3/2015 Gisler
9,314,841 B2 4/2016 Steiner et al.
9,757,798 B2 * 9/2017 Gisler ..... B22D 41/24
2005/0040572 A1 * 2/2005 Keller ..... B22D 41/34 266/271
2008/0157020 A1 * 7/2008 Rose ..... B22D 41/24 251/326
2015/0246392 A1 9/2015 Gisler et al.
2017/0259332 A1 * 9/2017 Zingre ..... B22D 41/34

FOREIGN PATENT DOCUMENTS

CH 707075 A2 4/2014
EP 1119428 B2 2/2000
WO 03103878 A1 12/2003
WO 2916116197 A1 7/2016

* cited by examiner

SLIDING CLOSURE FOR A CONTAINER CONTAINING MOLTEN METAL

FIELD OF THE INVENTION

The invention relates to a slide closure for a container containing molten metal, that has a housing part that can be fastened to the latter and a slider unit that can be displaced longitudinally relative to it, into which a fireproof slider plate can be inserted, the slider unit being held by a number of holding means fastened to the housing part perpendicular to the slider unit such that it can be displaced longitudinally.

BACKGROUND OF THE INVENTION

Slide closures of this type are well known to be used in continuous casting lines for opening and closing the spout opening of a metallurgical vessel. During operation the molten steel gives rise to high temperatures that are also transferred to the slider housing in the area surrounding the fireproof slider plates. In contrast, in the outer region of the housing substantially lower temperatures prevail, for example close to ambient temperature in the surrounding area. Nevertheless, the slider housing must also be stable in this region for the fastening of the holding means for the slider unit.

A slide closure of the type specified at the start is disclosed in publication EP-A-1 119 428 in which the housing part extends over the entire length and sideways to outside of the holding means in the direction of displacement so that these holding means are positioned in the region between the slider plates and the longitudinal walls of the housing part. In this way high rigidity of the slider housing can be achieved, but at the same time increased susceptibility to cracking occurs here because the large drop in temperature between the inside and the outside region of the housing causes different heat expansions and so very high stresses in the transition zone between the two regions.

In addition, the holding means fastened within the housing part on both sides of the closure plates are respectively connected to one another by means of a connection rod. The effect of this is that the slider unit can then only be released from the housing part if it can be displaced into this position lying outside of the open and the closed position in which tension of the spring components is then released.

OBJECTS AND SUMMARY OF THE INVENTION

The object underlying the invention is to avoid these disadvantages and to devise a slide closure of the type specified at the start, which can also be opened in the event of a breakdown, in particular when the slider unit can no longer be moved. The housing part should not be susceptible to cracking here and at the same time should be made to be sufficiently stable as regards strength so that the holding means, which hold the slider unit against the housing part, are mounted perfectly.

According to the invention, this object is achieved by a slide closure for a container containing molten metal including a housing part connectable to the container and receivable of a first plate, and which housing part includes a plurality of openings each defined by a surface including a plurality of grooves, a slider unit displaceable longitudinally relative to the housing part and receivable of a second plate, and holding units that hold the slider unit against the housing part when the slider unit is braced against the housing part.

Each holding unit has a bearing including longitudinal guides on an outer circumferential surface that correspond to the grooves on the surface. The longitudinal guides of each bearing are insertable into a respective opening in the housing part and securable therein.

By means of the releaseable individual fastening of the holding means to the housing part, such that in the braced state of the slide closure they can be released from the housing part in almost every position of the slider unit, a considerable advantage is offered during operation of a slide closure because with the latter, and with the disruptions that occur now and then, opening of the slide closure is made possible in many cases without the holding means and/or other parts having to be destroyed.

Very advantageously, the housing part of the slide closure has walls with lateral projections running relatively close to the slider plates in the longitudinal direction and which are provided with bearings for the individual holding means of the slider unit.

In this way the stresses otherwise occurring in the housing part can be largely eliminated because during operation the eye-shaped bearings can adapt to the heating independently of one another, even if there are considerable differences in temperature.

Nevertheless, the required rigidity of the housing is sufficiently ensured for the secure mounting of the holding means for the slider unit in the eye-shaped bearings of the housing, and an improved plate support that remains straight is thus achieved.

The invention also makes provision such that the housing part has two lateral projections on both sides, the bearings of which are arranged symmetrically to the spout opening of the slide closure in the housing part. This symmetrical arrangement enables optimal power transmission from the holding means to the slider unit, and so to the slider plates of the closure that are to be pressed against one another.

Furthermore, the invention makes provision such that the holding means are provided with slide rollers sliding on guide tracks of the slider unit parallel to the working plane of the slide closure, which slide rollers are loaded against the guide tracks by spring components disposed in the bearings. In this way any deformations of the eye-shaped bearings are compensated for without having any negative impact upon the guiding of the slider unit along its guide tracks.

In terms of a simple construction of the holding means it is advantageous if the latter have a bolt-shaped connection element guided in their bearings and a support for at least one slide roller preferably releasably connected to the connection element.

It is also advantageous with regard to construction and assembly if the eye-shaped bearings are in the form of bearing bushings and these projections accommodating the latter are provided with a semi-circular end part adapted to the bushing diameter, preferably in the form of a half-shell concluding the projection on the face side.

The invention also makes provision such that the slider unit is attached to the housing part by means of a hinge connection, the hinge leave of which are attached on the one hand to the slider unit and on the other hand directly to the one longitudinal wall of the housing part. In this way the hinge leaves are fastened securely to the housing part.

BRIEF DESCRIPTION OF THE DRAWINGS

The invention and additional advantages are described in more detail below by means of an exemplary embodiment with reference to the drawings. These show as follows.

DETAILED DESCRIPTION OF THE INVENTION

Figure 1:
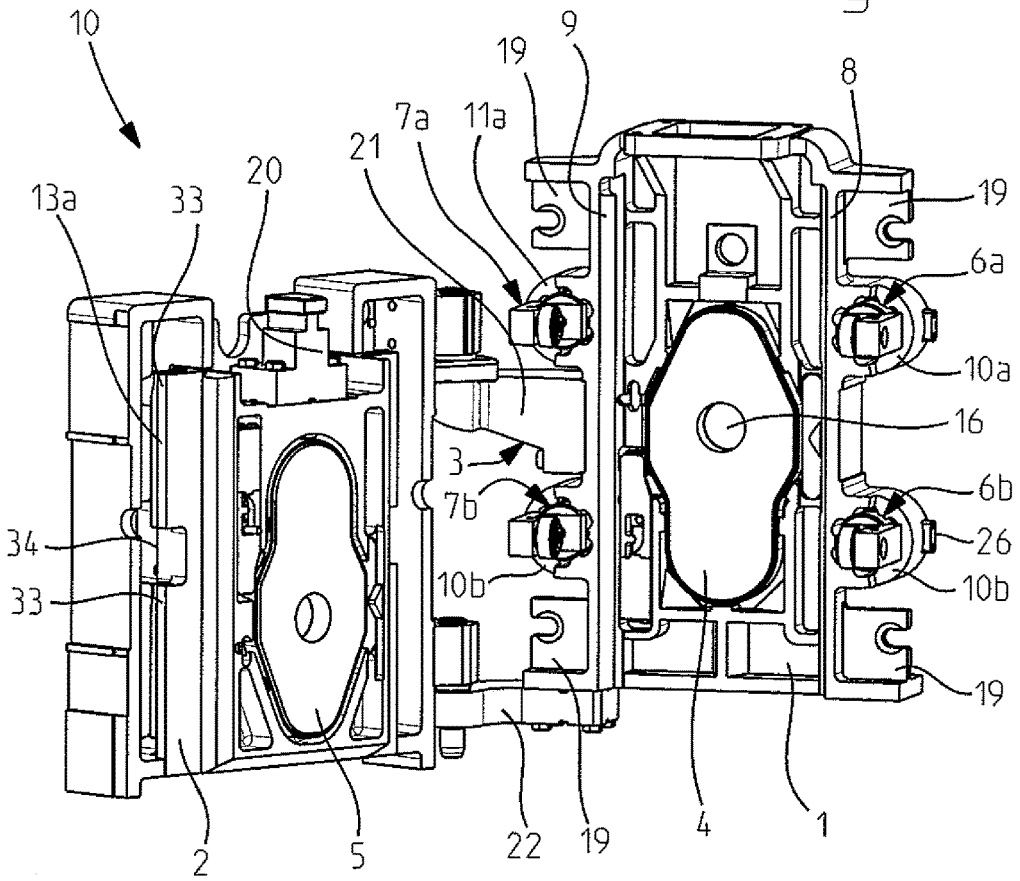
FIG. 1 shows a slide closure according to the invention, shown in the opened up state and perspectively.
Figure 2:
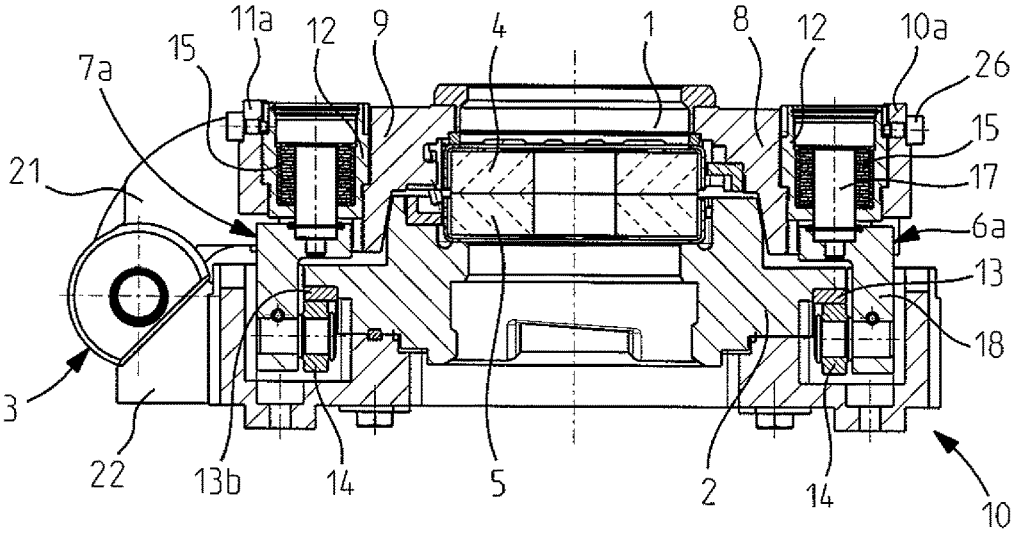
FIG. 2 shows the slide closure according to FIG. 1 in section and in the folded down position.

The slide closure 10 according to FIG. 1 and FIG. 2 is suitable as a closure component in a casting ladle (not detailed) or a similar container containing molten metal, as used in particular in continuous casting lines for steel. Needless to say, it is also suitable as a closure component, for example for foundries and also in the non-ferrous metal domain.

This slide closure 10 consists essentially of a housing part 1 and a slider unit 2 that can be displaced longitudinally relative to the latter and which is attached to the long side of the housing part 1 with a hinge connection 3. There is fastened within the housing 1 an upper fireproof base plate 4 against which, in the folded down state, a lower fireproof slider plate 5 of the slider unit 2 is pressed, the latter being held by a number of holding means 6*a*, 6*b* and 7*a*, 7*b* fastened perpendicularly to it on the housing part 1 such that it can be displaced longitudinally.

The housing part 1, that is normally cast, has outer walls 8, 9 running relatively close to the plates 4, 5 in the longitudinal direction and with side projections 10*a*, 10*b* and 11*a*, 11*b* which are provided with preferably eye-shaped bearings 12 for the individual holding means 6*a*, 6*b* and 7*a*, 7*b* of the slider unit 2.

The lateral walls 8, 9 of the housing part 1 are respectively designed to be a distance of approximately one to a number of centimeters away from the outsides of the plates 4, 5 so that this housing part 1 has an almost even temperature distribution in the operational state during casting.

The holding means 6*a*, 6*b* and 7*a*, 7*b* on their part are provided with slide rollers 14 sliding on guide tracks 13*a*, 13*b* of the slider unit 2 parallel to the working plane of the slide closure 10 which are loaded against the guide tracks 13*a*, 13*b* by spring components 15 integrated into the bearings 12. These guide tracks 13*a*, 13*b* are on their part split in two in a conventional manner by a respective opening 34 for the release of a respective slide roller 14 and are provided on the end with ramps 33 in order to be able to tension and release tension from the holding means, and with them the spring components, as explained in detail in publication EP-A-1 119 428.

The bearings 12 of the holding means 6*a*, 6*b*, 7*a*, 7*b* are in the form of bearing bushings, the projections 10*a*, 10*b*; 11*a*, 11*b* accommodating them being provided with a semi-circular end part adapted to the bushing diameter in the form of a half-shell concluding the projection on the face side.

As can be seen from FIG. 1, the housing part 1 has on both sides two respective lateral projections 10*a*, 10*b* and 11*a*, 11*b*, the bearings 12 of which are positioned within the housing part 1 symmetrically to the spout opening 16 of the slide closure 10. This arrangement enables optimal transmission of force from the holding means 6*a*, 6*b*; 7*a*, 7*b* to the slider unit 2 and so to the plates 4, 5 pressed against one another in the folded down state.

The individual holding means 6*a*, 6*b*; 7*a*, 7*b* consist of a bolt-shaped connection element 17 guided in the bearings 12 and a support 18 for the slide roller mounted on the latter and connected releasably to the connection element 17 in order to facilitate assembly. Alternatively, the support 18 can be provided on both sides with slide rollers running along their own guide tracks. Slide blocks and similar slide elements can also be used instead of slide rollers.

According to the invention, these holding means 6*a*, 6*b*; 7*a*, 7*b* are individually fastened releasably to the housing part 1 such that in the tensioned state of the slide closure 10 they can be released from the housing part in almost any position of the slider unit 2. This is particularly significant in the event of a breakdown when the slider unit can no longer be moved, primarily when there is a breakdown due to welded molten metal.

Figure 3:
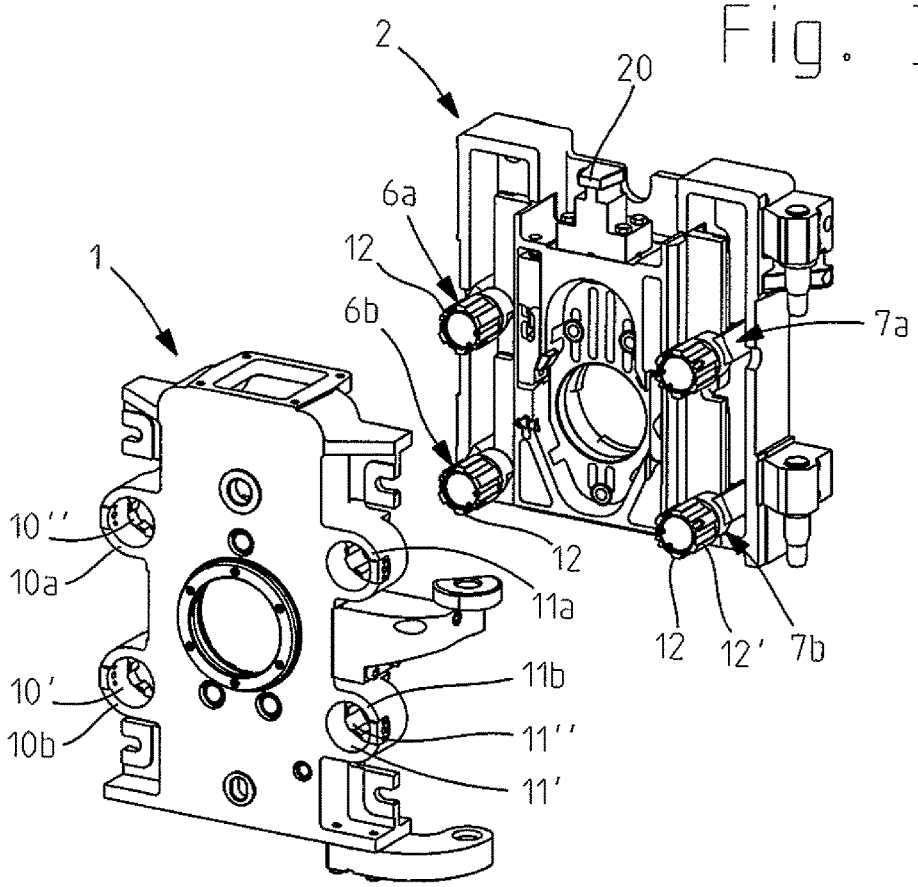
FIG. 3 shows a perspective view of the slide closure according to FIG. 1 in the slider unit according to the invention, released from the housing part.

FIG. 3 shows the slider unit 2 according to the invention released from the housing part 1. With the slider unit, the bearings 12 of the holding means 6*a*, 6*b*; 7*a*, 7*b* are respectively removed by turning the housing part 1 perpendicularly to the latter in the manner of a bayonet. The bearings 12, and with them the holding means 6*a*, 6*b*; 7*a*, 7*b*, are each turned about a specific angle, the slide rollers 14 connected to the latter thus also being swiveled, which slide rollers rest against the guide tracks 13*a*, 13*b* of the slider unit 2. The holding means 6*a*, 6*b*; 7*a*, 7*b* with the bearings 12 can then be removed from the slider unit 2 and, if necessary, be fastened within the housing part 1 once again.

Advantageously, the bearings 12 of the holding means 6*a*, 6*b*; 7*a*, 7*b* are respectively formed with longitudinal guides 12' running axially parallel on their outside evenly over the circumference. The longitudinal guides 12' can respectively be introduced like a bayonet into corresponding grooves 10", 11" of an opening 10', 11' in the projection 10*a*, 10*b* or 11*a*, 11*b* of the housing part 1 and then be secured in the latter housing part 1 by turning and fixing by means of a locking means 26. These openings 10', 11' are provided here with a cylindrical part in which a respective bearing 12 can be turned and positioned.

Figure 4:
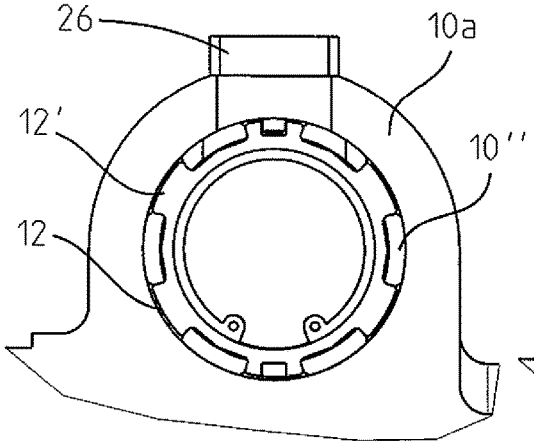
FIG. 4 shows a top view of a projection on the housing part of the slide closure according to FIG. 1 with the holding means fixed.

FIG. 4 shows the one projection 10*a* of the housing part 1 and the bearing 12 of a holding means fixed in the latter by the locking means 26. The bearing 12 is turned in the respective opening 10', 11' here until its longitudinal guides 12' lie over those of the openings 10', 11'.

Figure 5:
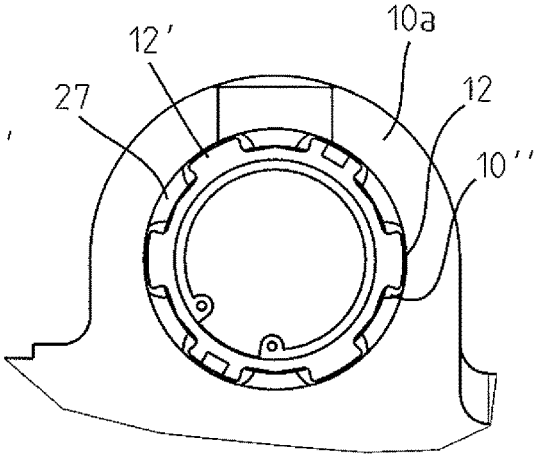
FIG. 5 shows a top view of the projection with the holding means released.

In contrast, FIG. 5 illustrates the position of the bearing 12 when the locking means 26 has been removed and with the turned position in the opening 10', 11', in which the bearing 12 is displaced by its longitudinal guides 12' through the grooves 10" and can be removed from the housing part 1. Longitudinal guides 27 corresponding to those of the bearing 12 are respectively assigned to the inner wall of the opening 10', 11', between which longitudinal guides the grooves 10" run.

In order to fasten the slide closure to the casting ladle fastening screws (not shown) are used which can be swiveled in corner plates 19 of the housing part 1 and can then be pulled against them.

The slider unit 2 on its part is actuated by a drive component (not illustrated either) in the form of a hydraulic cylinder, the push rod of which can be connected to a coupling claw 20 of the slider unit.

In order to make it possible to open and fold down the slide closure, the slider unit 2 is attached in a way known in its own right to the housing part 1 by means of the hinge connection 3, the hinge leaves 21, 22 being fastened on the one hand to the slider unit 2 and on the other hand directly to the one longitudinal wall 9 of the housing part 1.

The construction according to the invention of the housing part 1 is also suitable for a slide closure the holding means 7*a*, 7*b*; 8*a*, 8*b* of which are formed differently than described above in so far as mounting of the holding means in the projections 10*a*, 10*b*; 11*a*, 11*b* of the slider unit 2 is also possible with them.

The invention is sufficiently displayed by the exemplary embodiment that has been described. It could, however, also be illustrated by other variants. It could also be a three-plate slide closure in which a slider plate is disposed displaceably between the housing part and the slider unit in an additional frame in a conventional manner. The housing part would then be formed in the same way as the variant according to FIG. 1 with the advantages according to the invention, the slider unit than only being guided displaceably in order to automatically tension the closure.

The holding means could be fastened releasably to the housing part, but not like a bayonet, such as for example by a type of screw connection or a snap coupling or the like.

The invention claimed is:

1. A slide closure for a container containing molten metal, comprising:

a housing part connectable to the container and receivable of a first plate, said housing part including a plurality of openings each defined by a surface including a plurality of grooves;

a slider unit displaceable longitudinally relative to said housing part and receivable of a second plate; and holding units that hold said slider unit against said housing part when said slider unit is braced against said housing part, each of said holding units comprising a bearing including longitudinal guides on an outer circumferential surface that correspond to said grooves on said surface, said longitudinal guides of each of said bearings being insertable into a respective one of said openings in said housing part and securable therein.

2. The slide closure of claim 1, wherein for each of said bearings, said longitudinal guides are distributed evenly around said outer circumferential surface of said bearing.

3. The slide closure of claim 1, further comprising locking means for securing each of said bearings in the respective one of said openings.

4. The slide closure of claim 1, further comprising a plurality of locking devices, each of said locking devices engaging with a respective one of said bearings and being actuatable to turn and fix the respective one of said bearings in the respective one of said openings.

5. The slide closure of claim 1, wherein said holding units extend in a direction perpendicular to said housing part such that said bearings of said holding units are insertable into said openings in said housing part in a direction perpendicular to said housing part and removable from said openings in said housing part in the direction perpendicular to said housing part.

6. The slide closure of claim 1, wherein said holding units are each removably connected to said housing part individually such that each of said holding units is removable from engagement with said housing part without requiring removal of any other of said holding units from said housing part.

7. The slide closure of claim 1, wherein said holding units are insertable into said openings and removable from said openings in a manner of a bayonet.

8. The slide closure of claim 1, wherein said slider unit comprises guide tracks and each of said bearings further comprises a slide roller that rests against one of said guide tracks when said slider unit is braced against said housing part.

9. A slide closure for a container containing molten metal, comprising:

a housing part connectable to the container and receivable of a first plate, said housing part including longitudinally extending walls alongside a space in which the first plate is received and projections that protrude laterally from said walls in a direction outward from the space;

a slider unit displaceable longitudinally relative to said housing part and receivable of a second plate, said slider unit comprises guide tracks; and holding units connected to said housing part and that hold said slider unit against said housing part when said slider unit is braced against said housing part, each of said holding units comprising:

a bearing arranged in connection with one of said walls;

a slide roller that slides along one of said guide tracks when said slider unit is displaced relative to said housing part;

a spring that urges said slide roller against said one of said guide tracks, said spring being arranged in said bearing.

10. The slide closure of claim 9, wherein two of said projections protrude from each of said walls.

11. The slide closure of claim 10, wherein the slide closure defines a spout opening, said bearings being arranged on said projections, said projections and thus said bearings being arranged symmetrically relative to said spout opening.

12. The slide closure of claim 9, wherein said walls are situated a distance of approximately one to a number of centimeters from a surface defining the space in which the first place is received.

13. The slide closure of claim 9, wherein each of said holding units further comprises a bolt-shaped connection element guided in said bearing of said holding unit and a support releaseably connected to said bolt-shaped connection element, said slide roller being retained on or by said support.

14. The slide closure of claim 9, wherein said bearings are bearing bushings and are arranged in connection with said projections, said projections having a semi-circular end part adapted to an end diameter of said bearing bushings.

15. The slide closure of claim 9, further comprising a hinge connection for attaching said slider unit to said housing part, said hinge connection including hinge leaves fastened to said slider unit and directly to one of said walls of said housing part.

16. The slide closure of claim 9, wherein said holding units extend in a direction perpendicular to said housing part to enable longitudinal displacement of said slider unit relative to said housing part.

17. The slide closure of claim 9, wherein said guide tracks are parallel to a working plane of the slide closure.

18. A slide closure for a container containing molten metal, comprising:

a housing part connectable to the container and receivable of a first plate, said housing part including longitudinally extending walls alongside a space in which the first plate is received and projections that protrude laterally from said walls in a direction outward from the space;

a slider unit displaceable longitudinally relative to said housing part and receivable of a second plate; and holding units connected to said housing part and that hold said slider unit against said housing part when said slider unit is braced against said housing part, each of said holding units comprising a bearing bushing arranged in connection with one of projections, said projections having a semi-circular end part adapted to an end diameter of said bearing bushings.

19. The slide closure of claim 18, wherein said semi-circular end part of each of said projections includes a half-shell concluding said projection on an outwardly facing side of a respective one of said walls.

20. The slide closure of claim 18, wherein said holding units extend in a direction perpendicular to said housing part to enable longitudinal displacement of said slider unit relative to said housing part.

* * * * *